US005592860A

United States Patent [19]

Woodsum

[11] Patent Number: 5,592,860

[45] Date of Patent: Jan. 14, 1997

[54] RATCHET SOCKET BRAKE AND STARTER TOOL

[76] Inventor: David A. Woodsum, 2623 Gladiolus St., New Orleans, La. 70122

[21] Appl. No.: 573,117

[22] Filed: Dec. 15, 1995

[51] Int. Cl.[6] ..... B25B 13/58

[52] U.S. Cl. ..... 81/180.1; 81/177.85; 81/64

[58] Field of Search ..... 81/64, 177.1, 177.7, 81/177.85, 180.1

[56] References Cited

U.S. PATENT DOCUMENTS

| | | | |
|---|---|---|---|
| 3,839,929 | 10/1974 | Richards | 81/177.7 X |
| 4,007,651 | 2/1977 | Scott | 81/180.1 X |
| 4,762,031 | 8/1988 | Bradley | 81/180.1 X |
| 5,361,656 | 11/1994 | Starr | 81/180.1 |
| 5,509,333 | 4/1996 | Rion | 81/180.1 |

*Primary Examiner*—James G. Smith
*Attorney, Agent, or Firm*—Joseph N. Breaux

[57] ABSTRACT

A combined ratchet socket brake and starting tool comprising: a handle section, a pivot arm pivotally connected at one end to the handle section with a pivot mechanism, a pivot-arm slide-lock that is slidable over the pivot mechanism to lock the pivot arm in a fixed position with respect to the handle section, a horseshoe-shaped friction member having a disk receiving channel formed into the inner surface thereof, and a socket-post disk having a socket-post keyway formed through the center thereof and rotatably entrapped within the disk receiving channel in a manner such that a frictional force is developed between the socket-post disk and the friction member of sufficient magnitude to cause the socket post of a ratchet mechanism disposed through the socket-post keyway to cause the ratchet mechanism to ratchet.

20 Claims, 2 Drawing Sheets

RATCHET SOCKET BRAKE AND STARTER TOOL

Technical Field

The present invention relates to devices used to provide sufficient resistance to rotation of the socket attached to a ratchet type wrench to allow the ratchet mechanism to operate and, more particularly, to a device that engages the socket post of the ratchet type wrench with a thin disk having a keyway for engaging the socket post and includes a friction assembly that provides an overcomeable frictional resistance to rotation of the disk.

BACKGROUND ART

Ratchet type socket wrenches are a great advantage to mechanics under certain condition. The ratchet mechanism allows the socket to be progressively rotated in a single rotation direction while the drive portion of the ratchet wrench is rotated back and forth along a limited angular pathway. These ratchet type wrenches operate fine when the fastener being tightened has sufficient frictional resistance to prevent the socket secured to the drive post of the ratchet wrench from rotating back with the ratchet drive each time the drive portion of the ratchet wrench is rocked back by the user. When the socket moves back and forth with the drive portion, the fastener cannot be tightened with the wrench alone and the socket is usually grasped by the user until sufficient resistance is supplied by the fastener to allow the ratchet mechanism to operate without assistance. Although use of the fingers is often possible, it is not always possible for the user to physically position his/her hands close enough to grasp the socket. It would be a benefit, therefore, to have a brake device that could be used in conjunction with a socket type ratchet wrench that would supply sufficient resistance to the ratchet mechanism to allow the ratchet mechanism to operate properly. In addition, because various sized sockets are utilized with the same ratchet drive, it would be a further benefit if the same brake device could be utilized regardless of the socket utilized with the ratchet drive.

In some situations it is desirable to either hand tighten a fastener and then use the socket wrench to apply a tightening force to the fastener or to use the socket wrench to loosen a tightened fastener to the point that hand loosening is possible and then to finish removing the fastener by hand. Although this may be desirable, the location of the fastener may make such hand tightening and loosening difficult. It would be a benefit, therefore, if a brake device as previously discussed could be utilized as a starting tool to supply a rotational force to the socket in the desired direction. Because of the confined conditions in which such tightening must take place it would also be a benefit if a user could supply a reciprocating motion that was converted by the brake device to a rotational force for rotating the socket in the desired direction.

GENERAL SUMMARY DISCUSSION OF INVENTION

It is thus an object of the invention to provide a ratchet socket brake and starting tool that is used in conjunction with a socket type ratchet wrench to supply sufficient resistance to the ratchet mechanism to allow the ratchet mechanism to operate properly.

It is a further object of the invention to provide a ratchet socket brake and starting tool that operates with a variety of different socket sizes without adjustment of the tool or the ratchet drive.

It is a still further object of the invention to provide a ratchet socket brake and starting tool that, in conjunction with a ratchet wrench, can supply a tightening or loosening rotation to a fastener.

It is a still further object of the invention to provide a ratchet socket brake and starting tool that converts a reciprocating motion supplied by a user into a rotational force for rotating the socket in the desired direction.

It is a still further object of the invention to provide a ratchet socket brake and starting tool that achieves all or some of the above objects in combination.

Accordingly, a combined ratchet socket brake and starting tool is provided. The tool comprises: a handle section, a pivot arm pivotally connected at one end to the handle section with a pivot mechanism, a pivot-arm slide-lock that is slidable over the pivot mechanism to lock the pivot arm in a fixed position with respect to the handle section, a horseshoe-shaped friction member having a disk receiving channel formed into the inner surface thereof, and a fifteen socket-post disk having a socket-post keyway formed through the center thereof and rotatably entrapped within the disk receiving channel in a manner such that a frictional force is developed between the socket-post disk and the friction member of sufficient magnitude to cause a socket post of a ratchet mechanism disposed through the socket-post keyway to brake and cause the ratchet mechanism to ratchet. The fifteen sides are to insure gripping action of the horseshoe arms upon the disk even if oil seeps into the channel reducing friction.

The friction member has an opening defined between the ends of two arcuately shaped legs to allow for easy insertion and removal of the socket-post disk during use. The legs are flexible to allow for insertion of the socket-post disk into the disk receiving channel and to provide an overcomeable gripping force between the friction member and the socket-post disk. The term "overcomeable gripping force" is used herein to mean a frictional force between the friction member and the socket-post disk that is sufficient in magnitude to cause the ratchet mechanism of a ratchet-type socket wrench to operate but that will not completely stop rotation of the socket-post disk with respect to the friction member. The overcomeable gripping force is preferably supplied by constructing the friction member from a resilient plastic. However, it is contemplated by the inventor hereof that a resilient spring member may be secured to the legs or an elastic band may be affixed between the ends of the legs to supply the frictional force necessary to create the overcomeable frictional force.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
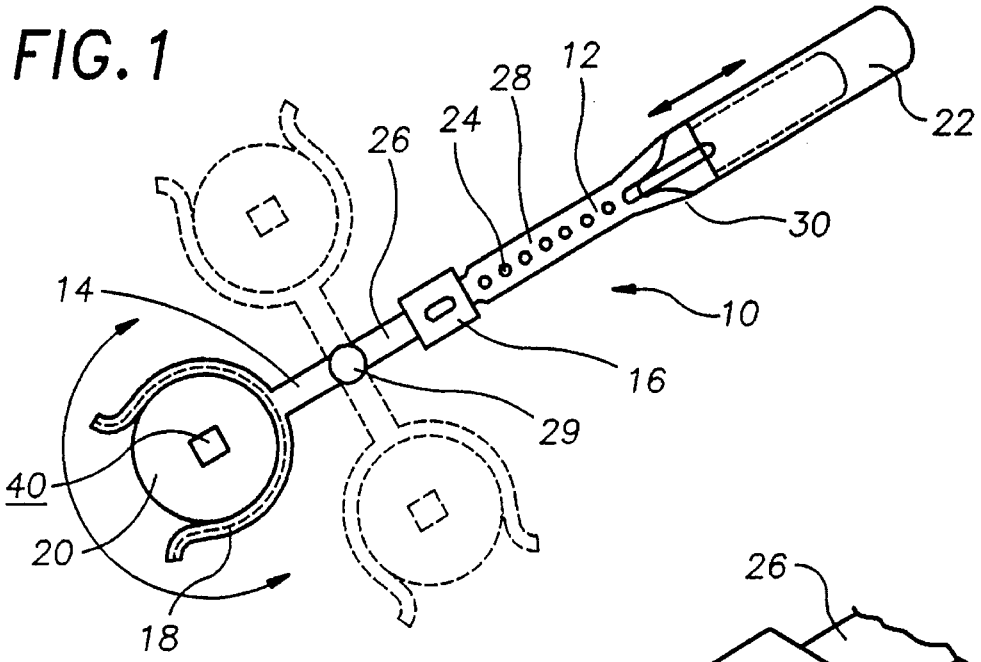
FIG. 1 is a top view of an exemplary embodiment of the combined socket brake and starting tool of the present invention showing the adjustable handle section, the pivot arm, the pivot arm slide-lock, the horseshoe-shaped friction member, and the socket-post disk.

FIG. 1 is a top view of an exemplary embodiment of the combined socket brake and starting tool of the present invention generally designated by the numeral 10. Tool 10 includes an adjustable handle section 12, a pivot arm 14, a pivot-arm slide-lock 16, a horseshoe-shaped friction member 18, and a socket-post disk 20.

Handle section 12 includes a gripping portion 22; a connecting portion 24 having a slide-lock length 26 and a compression length 28, and a securing fitting 30 for securing gripping portion 22 in a fixed relationship with connecting section 24 at the desired length. Securing fitting 30 has a pin that is user insertable within a desired securing hole formed through connecting section 24. Slide-lock length 26 is dimensioned smaller than compression length 28. This allows the junction between slide-lock length 26 and compression length 28 to be used as a slide stop for slide-lock 16.

Socket-post disk 20 is a thin, fifteen sided polygonal, plastic disk having a square socket-post keyway 40 formed through the center. Although a polygonal shaped disk is used in this embodiment, it should be understood that use of a circular disk is equally within the scope of the invention taught herein. Keyway 40 is dimensioned to allow passage therethrough of the socket post of a ratchet mechanism while simultaneously preventing rotation of the socket post with respect to socket-post disk 20. It can be seen, therefore, that when socket-post disk 20 is placed over a socket post the socket post and the socket-post disk rotate together.

Pivot arm 14 is pivotally connected to slide-lock length 26 of handle section 12 with a pivot mechanism 29. Pivot mechanism 29 allows pivot arm 14 to pivot about three-hundred (300°) degrees with respect to slide-lock length 26. In this embodiment, friction member 18 is integrally formed with pivot arm 14 and both are constructed from a plastic material having sufficient resilience to impart a frictional gripping force between friction member 18 and socket-post 20 sufficient to achieve ratcheting of a rachet mechanism when keyway 40 is placed over the socket post of the ratchet mechanism.

Figure 2:
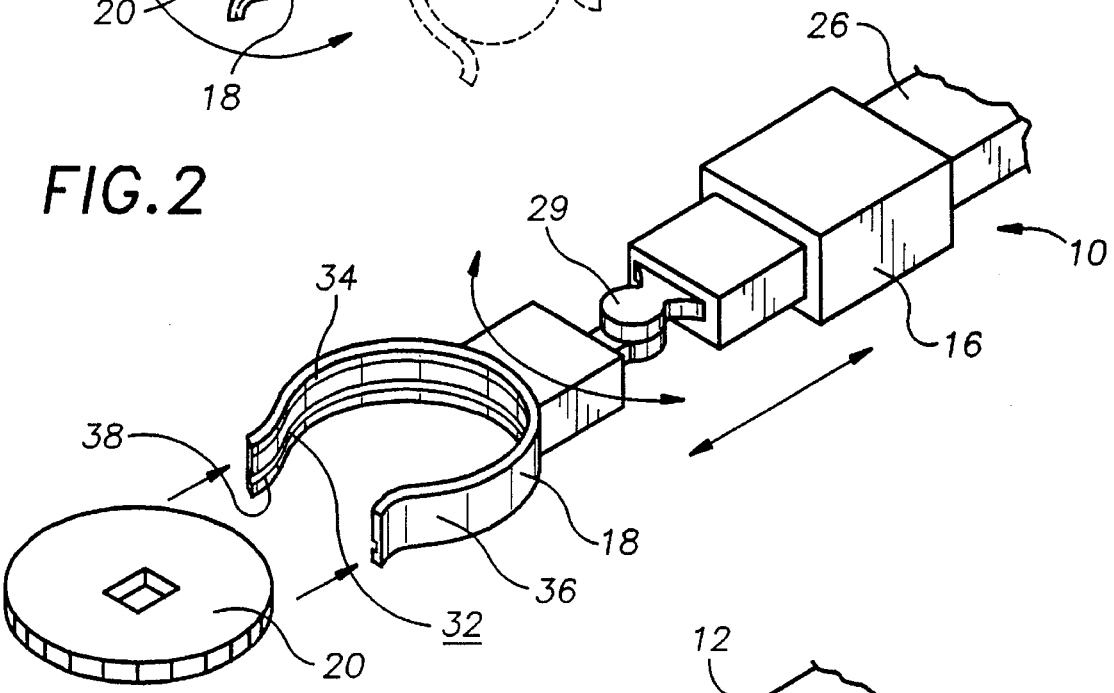
FIG. 2 is a detail perspective view of the tool of FIG. 1 showing the disk receiving channel and an optional gripping spring secured to the friction member for supplying additional gripping force between the socket-post disk and the friction member.

FIG. 2 is a detail perspective view of tool 10 showing socket-post disk 20 displaced from a disk receiving channel 32 that is formed along the interior sidewall of horseshoe-shaped friction member 18. In this figure, friction member 18 includes a resilient metal spring member 34 that is clipped upon the arcuately shaped legs 36,38 of friction member 18.

FIG. 2 also shows slide-lock 16 in the un-locked position with slide-lock 16 positioned completely on slide-lock length 26 away from pivoting mechanism 29. With respect to FIG. 3, slide-lock 16 is shown in the locking position with slide-lock 16 positioned entirely over pivoting mechanism 29 (not shown in the figure) and partially onto pivot arm 14 and slide-lock length 26. When slide-lock 16 is in this position, movement of pivot arm 14 is fixed with respect to handle section 12.

Figure 3:
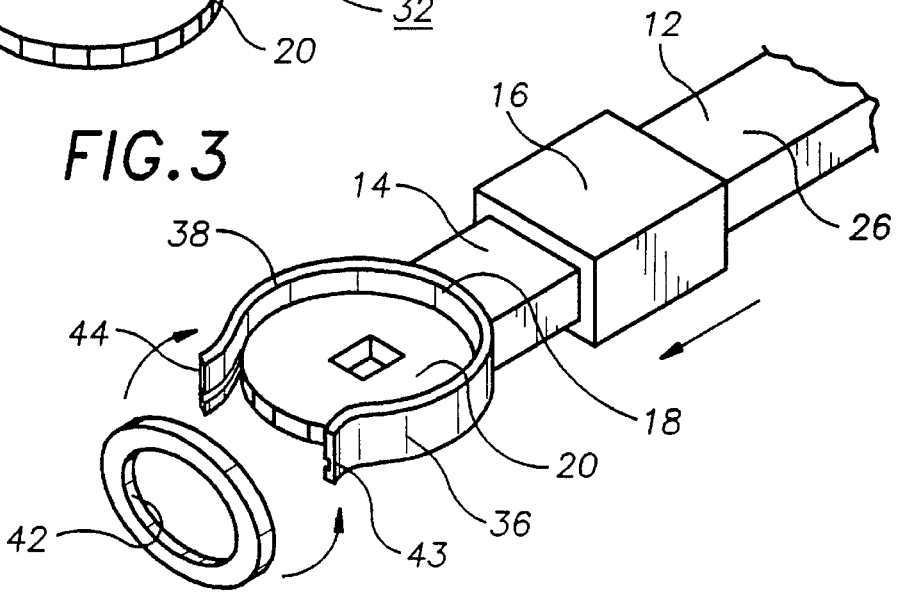
FIG. 3 is a second detail perspective view of the tool of FIG. 1 with the slide-locked positioned in the locking position. Also shown is an optional tension band that is positionable around end posts of the friction member after the socket-post disk is inserted into the disk receiving channel.

Also shown in FIG. 3 is a tension band 42. Stretching tension band 42 over the ends 43,44 of arms 36,38 is a second exemplary method of supplying the necessary frictional gripping relationship between friction member 18 and socket-post disk 20.

Figure 4:
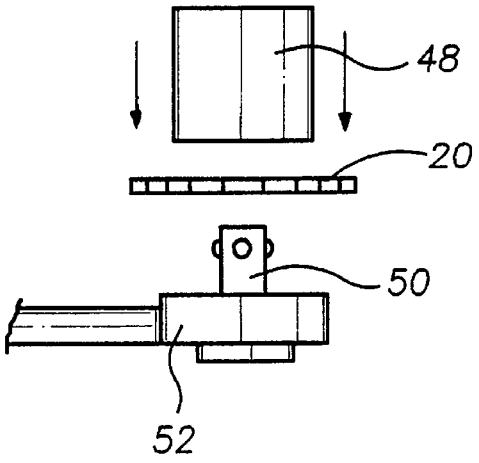
FIG. 4 is an exploded side view showing the socket-post disk positioned between a representative socket and a representative socket post extending from a representative ratchet-type wrench.
Figure 5:
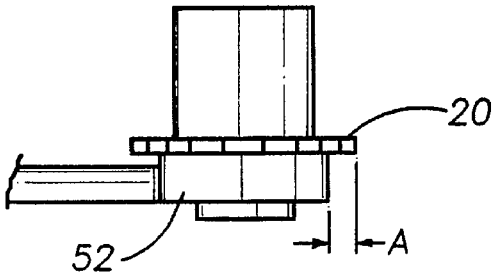
FIG. 5 is a side view showing the socket-post disk installed on the socket post of the representative ratchet-type wrench.

FIG. 4 is an exploded side view showing socket-post disk 20 positioned between a representative socket 48 and a representative socket post 50 extending from a representative ratchet-type wrench 52. FIG. 5 is a side view showing socket-post disk 20 installed on socket post 50 (FIG. 4). As shown, socket-post disk 20 extends outward from the perimeter of wrench 52 a distance "A" of about three-eighths (⅜") inch to allow clearance between friction member 18 and wrench 52 during use of tool 10.

Figure 6:
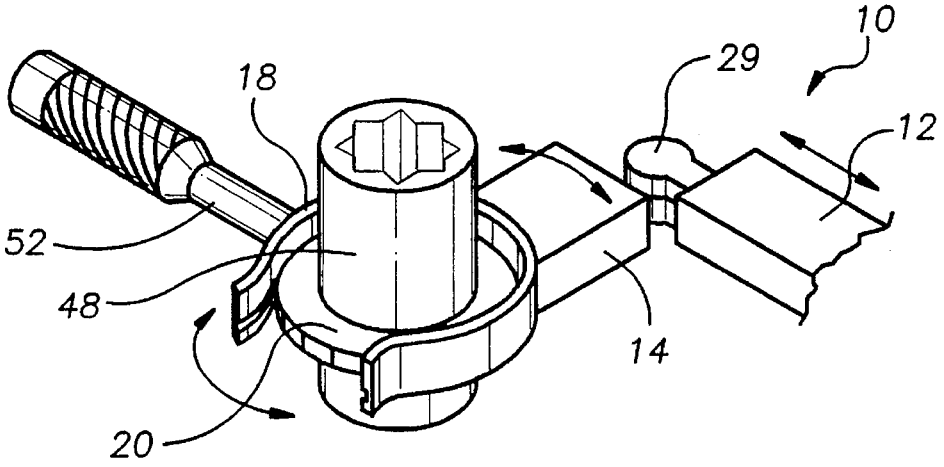
FIG. 6 is a perspective view of the tool of FIG. 1 in use.

FIG. 6 is a perspective view of tool 10 of FIG. 1 in use. As shown in the figure and well known to those skilled in the art, pivoting mechanism 29 allows a reciprocating movement of handle section 12 to cause pivoting member 14 and friction member 18 to pivot about socket 48. Depending on the ratcheting direction selected on wrench 52, socket-post disk 20 is sequentially advanced in either a clock-wise or counter-clockwise direction by reciprocating movements of handle section 12. It can also be seen that when in the same configuration and depending on the direction selected on wrench 52, rotation of wrench 52 in a first angular direction while holding handle section 12 in a fixed position will result in advancement of socket 48 in the desired direction while rotation of wrench 52 in a second opposite angular direction will result in operation of the ratchet mechanism and consequently no movement of socket 48. It can be understood, therefore, that no additional force is required from the fastener in order for the rachet mechanism of wrench 52 to operate.

It can be seen from the preceding description that a ratchet socket brake and starting tool has been provided that may be used in conjunction with a socket type ratchet wrench to supply a sufficient resistance to the ratchet mechanism to allow the ratchet mechanism to operate properly; that operates regardless of the socket utilized with the ratchet drive; that may be used in conjunction with a ratchet wrench to supply a tightening or loosening rotation to a fastener; and that converts a reciprocating motion supplied by a user into a rotational force for rotating the socket in the desired direction.

It is noted that the embodiment of the ratchet socket brake and starting tool described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A ratchet socket brake and starting tool comprising:

a handle section;

a pivot arm pivotally connected at one end to said handle section with a pivot mechanism;

a pivot-arm slide-lock that is slidable over said pivot mechanism to lock said pivot arm in a fixed position with respect to said handle section;

a horseshoe-shaped friction member having a disk receiving channel formed in an inner surface thereof; and a socket-post disk having a socket-post keyway formed through a center thereof, said socket-post disk being rotatably entrapped within said disk receiving channel in a manner such that a frictional force is developed between said socket-post disk and said friction member, said frictional force being of sufficient magnitude to cause a socket post of a ratchet mechanism disposed through said socket-post keyway to cause said ratchet mechanism to ratchet.

2. The ratchet socket brake and starting tool of claim 1, wherein:

said friction member has a disk opening defined between a first and second end of two arcuately shaped legs of said friction member.

3. The ratchet socket brake and starting tool of claim 2, wherein:

said friction member is constructed from a resilient material having sufficient resilience to allow said legs to supply said frictional force.

4. The ratchet socket brake and starting tool of claim 2 further including:

a resilient spring member secured to said legs in a manner to urge said legs against said socket-post disk and cause said frictional force.

5. The ratchet socket brake and starting tool of claim 2 further including:

an elastic band affixable between said ends of said legs and of a length selected to allow said elastic band to provide a biasing force urging said legs against said socket-post disk and causing said frictional force.

6. The ratchet socket brake and starting tool of claim 1 wherein:

said handle section includes a gripping portion; a connecting portion, and a securing mechanism engageable between said gripping portion and said connecting portion in a manner to provide a fixed relationship between said gripping portion and said connecting portion.

7. The ratchet socket brake and starting tool of claim 6 wherein:

said connecting portion includes a slide stop.

8. The ratchet socket brake and starting tool of claim 1, wherein:

said friction member is integrally formed with said pivot arm.

9. The ratchet socket brake and starting tool of claim 3, wherein:

said friction member is integrally formed with said pivot arm.

10. The ratchet socket brake and starting tool of claim 3 wherein:

said handle section includes a gripping portion; a connecting portion, and a securing mechanism engageable between said gripping portion and said connecting portion in a manner to provide a fixed relationship between said gripping portion and said connecting portion.

11. The ratchet socket brake and starting tool of claim 10 wherein:

said connecting portion includes a slide stop.

12. The ratchet socket brake and starting tool of claim 10, wherein:

said friction member is integrally formed with said pivot arm.

13. The ratchet socket brake and starting tool of claim 4, wherein:

said friction member is integrally formed with said pivot arm.

14. The ratchet socket brake and starting tool of claim 4 wherein:

said handle section includes a gripping portion; a connecting, portion, and a securing mechanism engageable between said gripping portion and said connecting portion in a manner to provide a fixed relationship between said gripping portion and said connecting portion.

15. The ratchet socket brake and starting tool of claim 14 wherein:

said connecting portion includes a slide stop.

16. The ratchet socket brake and starting tool of claim 14, wherein:

said friction member is integrally formed with said pivot arm.

17. The ratchet socket brake and starting tool of claim 5, wherein:

said friction member is integrally formed with said pivot arm.

18. The ratchet socket brake and starting tool of claim 5 wherein:

said handle section includes a gripping portion; a connecting portion, and a securing mechanism engageable between said gripping portion and said connecting portion in a manner to provide a fixed relationship between said gripping portion and said connecting portion.

19. The ratchet socket brake and starting tool of claim 18 wherein:

said connecting portion includes a slide stop.

20. The ratchet socket brake and starting tool of claim 18, wherein:

said friction member is integrally formed with said pivot arm.

* * * * *